US007174945B2

(12) United States Patent
Beals et al.

(10) Patent No.: US 7,174,945 B2
(45) Date of Patent: Feb. 13, 2007

(54) REFRACTORY METAL CORE WALL THICKNESS CONTROL

(75) Inventors: James T. Beals, West Hartford, CT (US); Samuel D. Draper, Kohler, WI (US); Jose Lopes, Glastonbury, CT (US); Stephen D. Murray, Marlborough, CT (US); Brandon W. Spangler, Vernon, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 11/337,293

(22) Filed: Jan. 23, 2006

(65) Prior Publication Data

US 2006/0118262 A1 Jun. 8, 2006

Related U.S. Application Data

(62) Division of application No. 10/687,231, filed on Oct. 16, 2003.

(51) Int. Cl.
*B22C 9/04* (2006.01)
*B22C 9/10* (2006.01)

(52) U.S. Cl. ..... 164/45; 164/361; 164/369; 164/519

(58) Field of Classification Search ..... 164/45, 164/361, 369, 516–519
See application file for complete search history.

(56) References Cited

U.S. PATENT DOCUMENTS

2005/0274478 A1* 12/2005 Verner et al. ..... 164/45

* cited by examiner

*Primary Examiner*—Kuang Y. Lin
(74) *Attorney, Agent, or Firm*—Bachman & LaPointe

(57) ABSTRACT

In accordance with the present invention, a casting system is provided which broadly comprises a core and a wax die spaced from said core, a refractory metal core having a first end seated within a slot in the core and a second end contacting the wax die for positioning the core relative to the wax die, and the refractory metal core having at least one of a mechanism for providing spring loading when closed in the wax die and a mechanism for mechanically locking the wax die to the core.

12 Claims, 2 Drawing Sheets

REFRACTORY METAL CORE WALL THICKNESS CONTROL

CROSS-REFERENCE TO RELATED APPLICATION(S)

This application is a divisional application of U.S. patent application Ser. No. 10/687,231, filed Oct. 16, 2003, entitled REFRACTORY METAL CORE WALL THICKNESS CONTROL, By James T. Beals et al.

BACKGROUND OF THE INVENTION (1) Field of the Invention

The present invention relates to a casting system for use in forming turbine engine components and to a refractory metal core used therein.

(2) Description of the Related Art

Investment casting is a commonly used technique for forming metallic components having complex geometries, especially hollow components, and is used in the fabrication of superalloy gas turbine engine components. The present invention will be described in respect to the production of superalloy castings, however it will be understood that the invention is not so limited.

Cores used in investment casting techniques are fabricated from ceramic materials which are fragile, especially the advanced cores used to fabricate small intricate cooling passages in advanced gas turbine engine hardware. These ceramic cores are prone to warpage and fracture during fabrication and during casting.

Conventional ceramic cores are produced by a molding process using a ceramic slurry and a shaped die. The pattern material is most commonly wax although plastics, low melting point metals, and organic compounds, such as urea, have also been employed. The shell mold is formed using a colloidal silica binder to bind together ceramic particles which may be alumina, silica, zirconia, and alumina silicates.

The investment casting process used to produce a turbine blade, using a ceramic core is as follows. A ceramic core having the geometry desired for the internal cooling passages is placed in a metal die whose walls surround but are generally spaced away from the core. The die is filled with a disposable pattern material such as wax. The die is removed leaving the ceramic core embedded in a wax pattern. The outer shell mold is then formed about the wax pattern by dipping the pattern in a ceramic slurry and then applying larger, dry ceramic particles to the slurry. This process is termed stuccoing. The stuccoed wax pattern, containing the core is then dried and the stuccoing process repeated to provide the desired shell mold wall thickness. At this point, the mold is thoroughly dried and heated to an elevated temperature to remove the wax material and strengthen the ceramic material.

The result is a ceramic mold containing a ceramic core which in combination define a mold cavity. It will be understood that the exterior of the core defines the passageway to be formed in the casting and the interior of the shell mold defines the external dimensions of the superalloy casting to be made. The core and shell may also define casting portions such as gates and risers which are necessary for the casting process but are not part of the finished cast component.

After removal of the wax, molten superalloy material is poured into the cavity defined by the shell mold and core assembly and solidified. The mold and core are then removed from the superalloy casting by a combination of mechanical and chemical means.

Attempts have been made to provide cores for investment casting which have improved mechanical properties, thinner thicknesses, improved resistance to thermal shock, and new geometries and features. One such attempt is shown in published U.S. Patent Application No. 2003/0075300, which is incorporated by reference herein. These efforts have been to provide ceramic cores with embedded refractory metal elements.

There remains a need however to improve the casting yields when these ceramic cores are being used. One particular problem which needs to be addressed is how to better maintain the position of the core in the wax die and during shelling and maintain the position of the core within the shell during casting.

Historically, pins of platinum, quartz, or alumina have been used in investment castings to support the casting core and prevent core shift. Pins are highly effective during the wax and shelling operations, but as platinum dissolves in molten alloy, the platinum pins are not as effective in maintaining position during casting. Ceramic-pins have disadvantages in that they leave holes or inclusions in the castings.

SUMMARY OF THE INVENTION

Accordingly, it is an object of the present invention to provide an improved technique for holding the ceramic core in position in the wax die and during shelling.

The foregoing object is attained by the present invention.

In accordance with the present invention, a casting system is provided which broadly comprises a first core and a wax die spaced from the core, a refractory metal core having a first end seated within a slot in the first core and a second end contacting the wax die for positioning the first core relative to the wax die, and the refractory metal core having at least one of a means for providing spring loading when closed in the wax die and a means for mechanically locking the wax die to the first core.

The present invention also relates to a refractory metal core for maintaining a ceramic or refractory metal core in a desired position with respect to a wax die and avoiding core shift during casting. The refractory metal core comprises a core element formed from a refractory metal material. The core element has at least one integrally formed spring tab to provide spring loading when closed in said wax die.

Still further, the present invention relates to a refractory metal core for maintaining a ceramic or refractory metal core in a desired position with respect to a wax die. The refractory metal core comprises a core element formed from a refractory metal material, which core element has a first end, a central portion, and a second end positioned at an angle to the central portion for engaging a slot in the wax die.

Other details of the refractory metal core wall thickness control of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
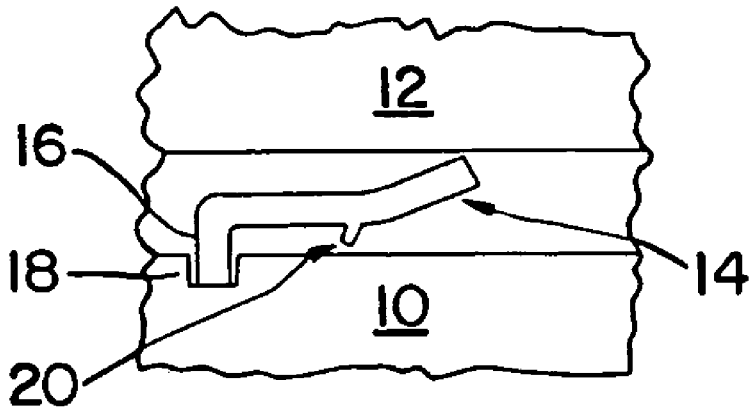
FIG. 1 is a side view of a first embodiment of the casting system of the present invention.
Figure 2:
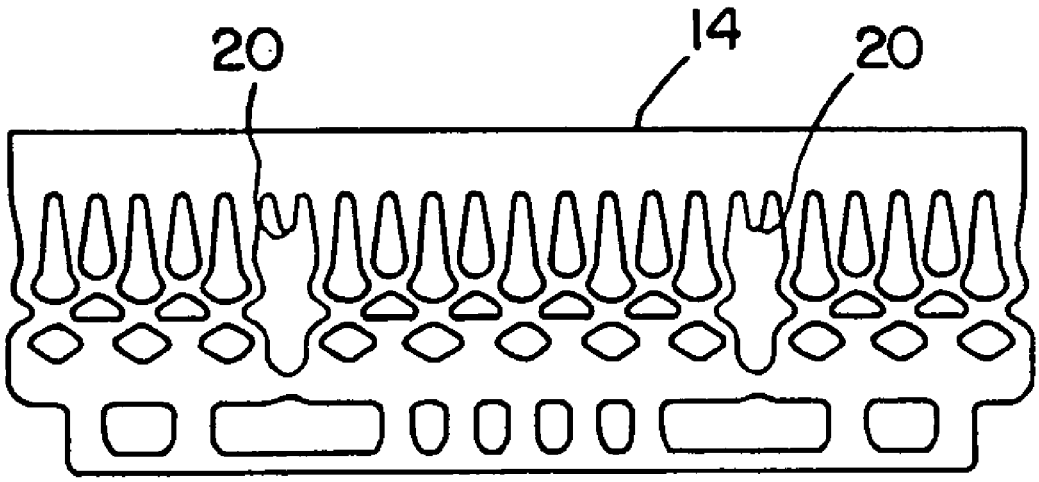
FIG. 2 is a top view of the refractory metal core used in the casting system of FIG. 1.

Referring now to the drawings, FIGS. 1 and 2 illustrate a first embodiment of a casting system in accordance with the present invention. The casting system includes a ceramic or refractory metal core 10, a wax die 12 spaced from the core 10, and a refractory metal core 14 positioned between the core 10 and the wax die 12. The refractory metal core 14 may be formed from a material selected from the group consisting of molybdenum, tantalum, niobium, tungsten, alloys thereof, and intermetallic compounds thereof. A preferred material for the refractory metal core 14 is molybdenum and its alloys. If desired, the refractory metal core 14 may be provided with a protective ceramic coating. The refractory metal provides more ductility than conventional ceramic while the ceramic coating, if present, protects the refractory metal during the shell fire step of the investment casting process and prevents dissolution of the core 14 from molten metal.

The refractory metal core 14 has at least one engagement member 16 at a first end which fits into a slot 18 in the core 10. If desired, the refractory metal core 14 may have a plurality of integrally formed spaced apart engagement members 16 which fit into a plurality of spaced apart slots 18 in the core 10. The refractory metal core 14 also has a second end which abuts a surface 19 of the wax die.

The refractory metal core 14 also preferably has at least one integrally formed spring tab 20 for providing spring loading when closed in the wax die. In a preferred embodiment, the refractory metal core 14 has a plurality of spaced apart tabs 20. The tab(s) 20 are preferably designed to have a high aspect ratio where aspect ratio is defined by the formula AR=L/D where L is the length of the tab and D is the width of the tab. The tab(s) 20 may also be designed to have a tapered or non-tapered end to minimize the chances of protruding through a wall.

By providing the tab(s) 20, the elastic properties and ductility of the refractory metal core 14 is used to create a spring like effect that better positions the refractory metal core in the wax die and better maintains the position of the core 10 when shelled.

Figure 3:
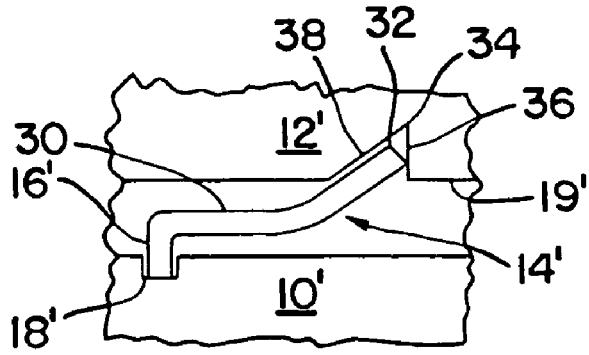
FIG. 3 is a side view of a second embodiment of the casting system of the present invention.
Figure 4:
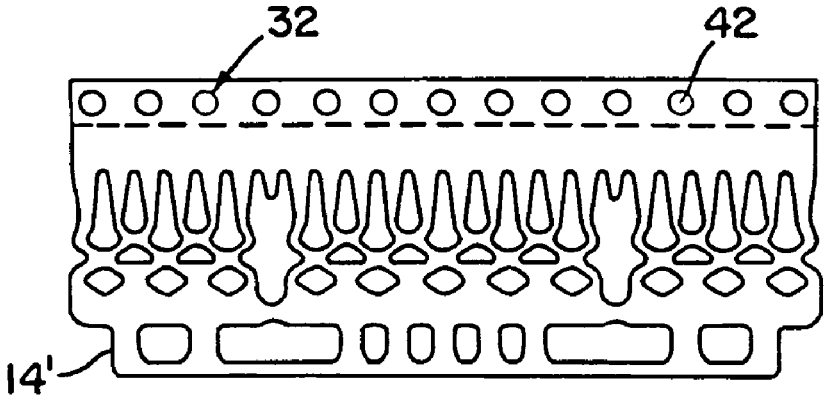
FIG. 4 is a top view of the embodiment of FIG. 3.

Referring now to FIGS. 3 and 4, a second embodiment of a casting system in accordance with the present invention is illustrated. In this embodiment, the refractory metal core 14' is used to form a core/shell tie. As can be seen from the figure, the core 14' has at least one engagement member 16' at a first end which fits into at least one slot 18' in the ceramic or refractory metal core 10'. The core 14' also has a planar central portion 30 and at least one end portion 32 angled with respect to the central portion. If desired, the core 14' may be provided with a plurality of spaced apart end portions or tabs 32. The end portion(s) 32 at its terminal end fits into at least one slot 34 in the wax die 12'. As shown in FIG. 3, the slot may be triangularly shaped in cross section. Alternatively, the slot may be U-shaped in cross section if a terminal portion of end portion 32 is substantially perpendicular to a surface 19' of the wax die 12'.

As can be seen from the figure, each slot 34 may have a rear wall 36 which is substantially perpendicular to the surface 19' of the wax die 12'. Each slot 34 may also have an angled wall 38. Each end portion 32 may abut against the rear wall 36 at its end and may be angled so as to contact the angled wall 38. By providing such an arrangement, a mechanical lock is provided.

Figure 5:
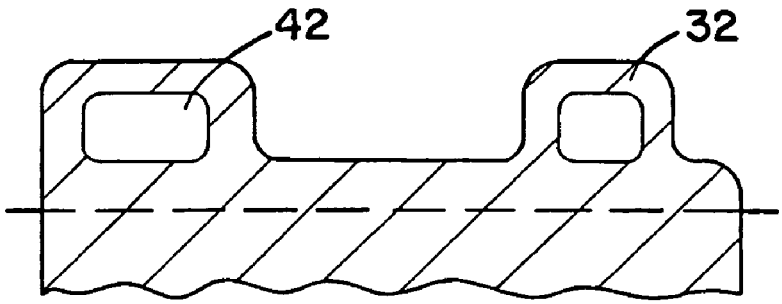
FIG. 5 is a schematic representation of a portion of a refractory metal core used in the casting system of FIG. 3.

If desired, the end portion(s) or tab(s) 32, as shown in FIG. 5, may have at least one hole 42 for mechanically trapping the shell and mechanically locking the part to the core. The end portion(s) 32 may have any shape that can hold the shell. The refractory metal core 14' thus improves core support by providing a core/shell tie.

One of the advantages of the refractory metal core of the present invention is that it has mechanical properties at casting temperatures that are far superior to platinum. The coating which is provided on the refractory metal core protects the refractory metal against dissolution during the casting cycle allowing more effective control. Further, the ductility of the refractory metal core helps prevent core breakage.

Traditional ceramic cores have densities much lower than the cast nickel superalloy. During casting, the cores can float causing wall thickness variation and even core kiss out (unwanted ceramic protrusion due to shifting in the shell). The refractory metal cores of the present invention typically have densities much higher than the cast superalloy and therefore counteracts buoyancy forces better than ceramic cores, which will improve casting yield by reducing kiss-out and wall thickness variations. Still further, the refractory metal cores of the present invention can be strategically placed on a ceramic core to minimize core float.

The refractory metal cores of the present invention enable advanced cooling of turbine components including airfoils by keeping the casting core positioned in a relatively thin wall. The ductility of the refractory metal cores allows for innovative processing of intricate geometries as well as provide positioning and wall thickness control.

It is apparent that there has been provided in accordance with the present invention a refractory metal core wall thickness control which fully satisfies the objects, means, and advantages set forth hereinbefore. While the present invention has been described in the context of specific embodiments thereof, other alternatives, modifications, and variations will become apparent to those skilled in the art having read the foregoing description. Accordingly it is intended to embrace those alternatives, modifications, and variations which fall within the broad scope of the appended claims.

What is claimed is:

1. A casting system comprising:

a first core and a wax die spaced from said first core;

a refractory metal core having a first end seated within a slot in said first core and a second end contacting said wax die for positioning said first core relative to said wax die; and said refractory metal core having means for providing spring loading when closed in said wax die.

2. The casting system according to claim 1, wherein said refractory metal core has said spring loading means and said spring loading means comprises at least one integrally formed spring tab.

3. The casting system according to claim 2, wherein said spring loading means comprises a plurality of spaced apart spring tabs.

4. The casting system according to claim 2, wherein each said tab has a tapered end.

5. The casting system according to claim 2, wherein each said tab has a non-tapered end.

6. The casting system according to claim 1, wherein the refractory metal core is formed from a material selected from the group consisting of molybdenum, tantalum, niobium, tungsten, alloys thereof, and intermetallic compounds thereof.

7. A casting system comprising:

a first core and a wax die spaced from said first core;

a refractory metal core have a first end seated within a slot in said first core and a second end contacting said wax die for positioning said first core relative to said wax die; and said refractory metal core having means for mechanically locking the wax die to said refractory metal core.

8. The casting system according to claim 7, wherein said refractory metal core has said mechanical locking means and said wax die is provided with a slot for receiving said mechanical locking means of said refractory metal core.

9. The casting system according to claim 8, wherein said mechanical locking means comprises said second end of said refractory metal core being angled to fit within said slot.

10. The casting system according to claim 9, wherein said slot in said wax die has a wall perpendicular to a surface of said die and said second end of said refractory metal core abuts said wall.

11. The casting system according to claim 7, wherein said mechanical locking means comprises at least one hole in said second end of said refractory metal core.

12. The casting system according to claim 7, wherein the refractory metal core is formed from a material selected from the group consisting of molybdenum, tantalum, niobium, tungsten, alloys thereof, and intermetallic compounds thereof.

* * * * *